US010868391B2

(12) United States Patent
Lim et al.

(10) Patent No.: US 10,868,391 B2
(45) Date of Patent: Dec. 15, 2020

(54) CONNECTOR AND CONNECTOR ASSEMBLY INCLUDING THE SAME

(71) Applicant: Aptiv Technologies Limited, St. Michael (BB)

(72) Inventors: Jae-Sang Lim, Hwaseong-si (KR); Jae-Yup Jung, Pyeongtaek-si (KR); Ju Won Seo, Namdong-gu (KR); Joo Hyun Park, Gyeonggi-do (KR); Gert Droesbeke, Erkrath (DE)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 16/552,368

(22) Filed: Aug. 27, 2019

(65) Prior Publication Data

US 2020/0076125 A1 Mar. 5, 2020

(30) Foreign Application Priority Data

Aug. 29, 2018 (KR) ..... 10-2018-0102214

(51) Int. Cl.
*H01R 13/62* (2006.01)
*H01R 13/627* (2006.01)

(52) U.S. Cl.
CPC ..... *H01R 13/6272* (2013.01)

(58) Field of Classification Search
CPC ..... H01R 13/6272
USPC ..... 439/352
See application file for complete search history.

(56) References Cited

U.S. PATENT DOCUMENTS 3,790,923 A * 2/1974 Mathe ..... H01R 13/743 439/557
4,541,036 A * 9/1985 Landries ..... H02B 1/048 220/3.6
4,986,766 A * 1/1991 Leonard ..... H01R 13/6272 439/352
5,295,855 A * 3/1994 Walz ..... H01R 13/6272 285/319
5,314,347 A * 5/1994 Colleran ..... H01R 13/633 439/350
5,399,045 A * 3/1995 Yoneda ..... H01R 13/5219 403/321
5,496,190 A * 3/1996 Ittah ..... H01R 13/6272 439/354
5,624,272 A * 4/1997 Ohsumi ..... H01R 13/6272 439/353
5,651,697 A * 7/1997 Cinquegrani ..... H01R 13/6272 439/374
5,873,747 A * 2/1999 Tsuji ..... H01R 13/6272 439/357
5,971,789 A * 10/1999 Sukegawa ..... H01R 13/6275 439/352
6,126,484 A * 10/2000 Klein ..... H01R 13/4223 439/157

(Continued)

FOREIGN PATENT DOCUMENTS

KR 1020180059247 A 6/2018

*Primary Examiner* — Alexander Gilman
(74) *Attorney, Agent, or Firm* — Billion & Armitage; Michael A. Collins

(57) ABSTRACT

A connector according to an embodiment is provided. The connector may include: a body in which at least one terminal is inserted; a bridge formed on a first side of the body; a latch connected to a second side of the body and extending toward the bridge; and at least one connection rib having a first end connected to an inner side of the bridge and a second end connected to an outer side of the latch.

13 Claims, 11 Drawing Sheets

(56) References Cited

U.S. PATENT DOCUMENTS 6,132,233 A * 10/2000 Fukuda ..... H01R 13/6272 439/352
6,383,011 B2 * 5/2002 Chen ..... H01R 13/6271 439/357
6,638,096 B1 * 10/2003 Jones ..... H01R 13/6272 439/352
6,669,398 B2 * 12/2003 Wada ..... C08J 9/0004 403/322.4
6,945,807 B1 * 9/2005 Wu ..... H01R 13/6271 439/354
7,033,230 B2 * 4/2006 Horiuchi ..... H01R 13/6272 439/752
7,118,417 B2 * 10/2006 Aihara ..... H01R 13/6272 439/595
7,214,090 B2 * 5/2007 Aihara ..... H01R 13/6272 439/358
7,232,329 B1 * 6/2007 Wu ..... H01R 12/62 439/358
7,261,583 B2 * 8/2007 Ikeya ..... H01R 13/6272 439/357
8,678,846 B2 * 3/2014 Hitchcock ..... H01R 13/6272 439/352
8,777,651 B2 * 7/2014 Miyawaki ..... H01R 13/6272 439/354
9,281,619 B2 * 3/2016 Morello ..... H01R 13/6272
9,935,396 B2 * 4/2018 Endo ..... H01R 13/6271
10,038,278 B2 * 7/2018 Lane ..... H01R 13/6272
10,263,363 B2 * 4/2019 Kida ..... H01R 13/6272
10,404,012 B1 * 9/2019 Stoyanov ..... H01R 13/6272
2017/0077650 A1 * 3/2017 Chang ..... H01R 13/641
2020/0076125 A1 * 3/2020 Lim ..... H01R 13/6272

* cited by examiner

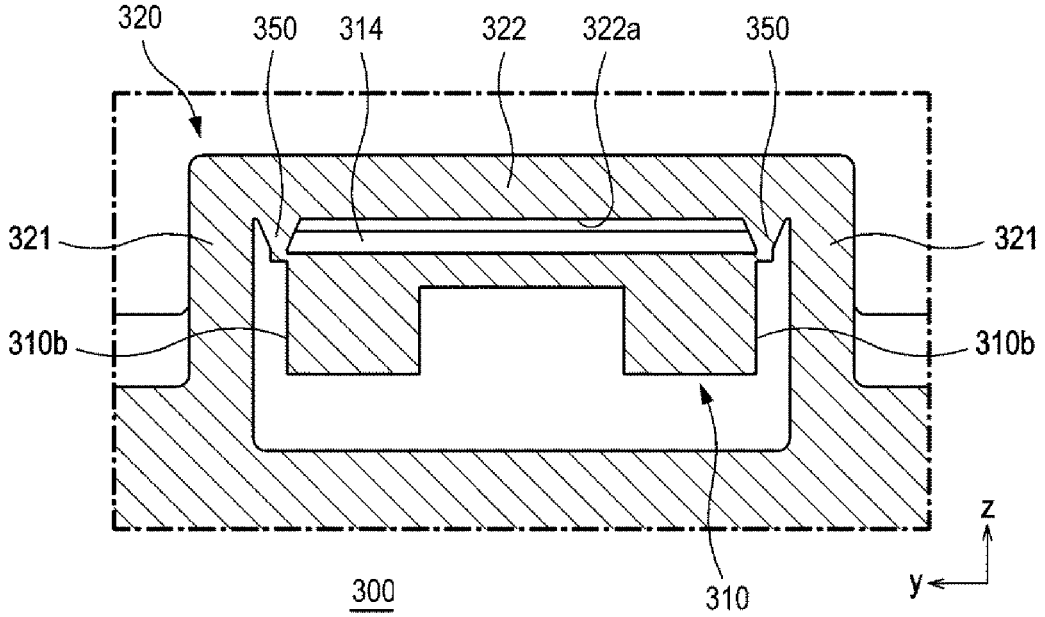
Fig. 7a
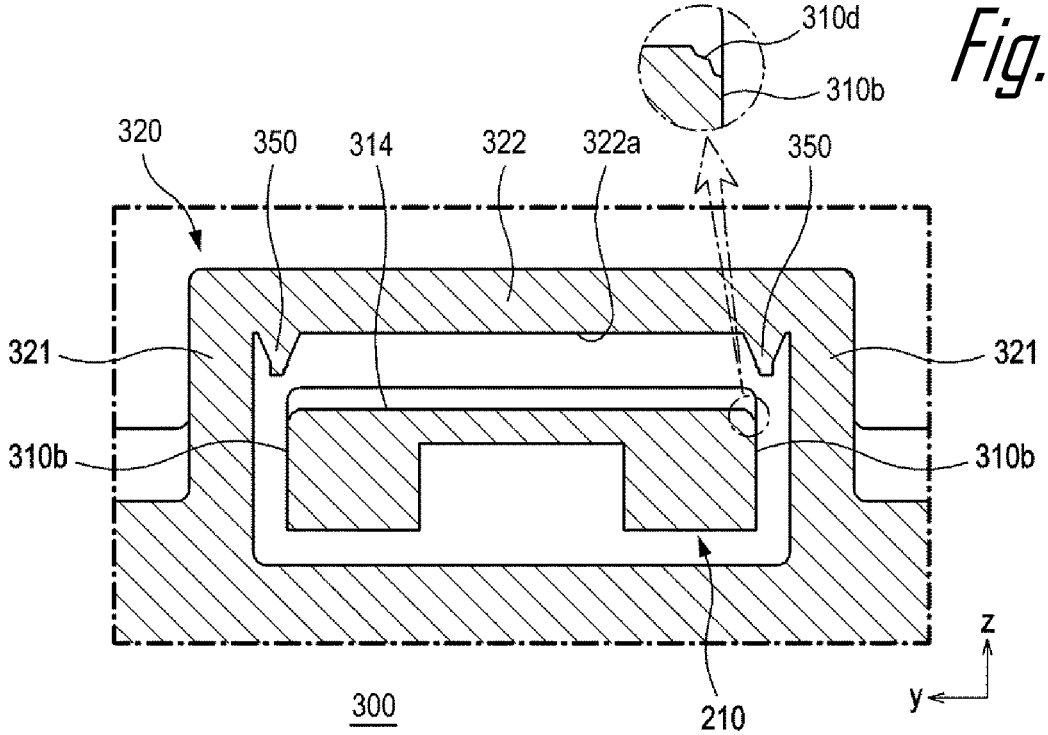
Fig. 7c
Fig. 7b

| Evaluation items | Requirements | Test Result | |
|---|---|---|---|
| | | Comparative Example | Example |
| Connector insertion force | Should be less than 74.5 N<br>The force when the second connector is inserted into the first connector is regulated | 53.0 to 70.0 N | 55.4 to 66.7 N |
| Unlocking force | Unlocked at 4.9 to 58.8 N<br>The external force is applied to the tip of the latch to measure the maximum value of the external force under the condition that the connecting rib is not broken | 4.9 to 5.5 N | 16.0 to 19.5 N |
| Connector tightening sound | Secured over 65 dB<br>Prevents incomplete assembling and improve sensibility quality of connector assembly | 67 to 70 dB | 77 to 80 dB |

Fig. 11

CONNECTOR AND CONNECTOR ASSEMBLY INCLUDING THE SAME

CROSS-REFERENCE TO RELATED APPLICATION

This application claims the benefit under 35 U.S.C. § 119(a) of Korean Patent Application No. 10-2018-0102214, filed on Aug. 29, 2018, the entire contents of which are incorporated herein by reference.

TECHNICAL FIELD

The present disclosure relates to a connector and a connector assembly including the same.

BACKGROUND

A connector is a connecting part that is used to electrically connect one circuit to another circuit. Further, connectors are used to connect or couple cables or wires in a vehicle and the connectors connected in this way are fixed by clips to a vehicle body to prevent interference with other components of the vehicle.

As described above, a connector is a connecting member that functions as a medium for connecting wires that are used in a vehicle, and various electronic devices exchange signals through connectors for smooth operation. Recently, various devices for efficiently driving a vehicle and adjusting a flow rate that is used have been developed, so the demand and importance of connectors that connect signals generated by the devices have increased.

Connectors may be classified into a male connector and a female connector. A male connector and a female connector can constitute a connector assembly. A male connector is partially inserted in a female connector, whereby terminals inserted in the connectors can be electrically connected. A locking structure is provided between a male connector and a female connector, so it is possible to prevent the male connector from being separated from the female connector.

SUMMARY

The present disclosure provides a connector configured to prevent sagging of a latch by connecting the latch and a bridge through a rib.

According to an aspect of the present disclosure, a connector may include: a body in which at least one terminal is inserted; a bridge formed on a first side of the body; a latch connected to a second side of the body and extending toward the bridge; and at least one connection rib having a first end connected to an inner side of the bridge and a second end connected to an outer side of the latch.

According to an embodiment, the bridge may have two side walls formed at both sides of the latch and an upper wall connecting upper ends of the two side walls, and the first end of the at least one connection rib may be connected to an inner side of the upper wall and the second end of the at least one connection rib may be connected to a top of the latch.

According to an embodiment, the at least one connection rib may be configured to connect a center portion of the upper wall and a center portion of the latch.

According to an embodiment, the latch may have a latch rib extending in a longitudinal direction of the latch and connected to the second end of the at least one connection rib.

According to an embodiment, the bridge may have two side walls formed at both sides of the latch and an upper wall connecting upper ends of the two side walls, and the at least one connection rib may be provided as two pieces and configured to connect both sides of the latch and the upper wall of the bridge.

According to an embodiment, the bridge may have two side walls formed at both sides of the latch and an upper wall connecting upper ends of the two side walls, and the at least one connection rib may be provided as two pieces and configured to connect both edges of a top of the latch and an inner side of the upper wall.

According to an embodiment, the bridge may have two side walls formed at both sides of the latch, and the at least one connection rib may be provided as two pieces and configured to connect both sides of the latch and inner sides of the two side walls.

According to an embodiment, the bridge may have two side walls formed at both sides of the latch and two upper walls extending respectively from the two side walls toward the latch with the latch therebetween, and the at least one connection rib may be provided as two pieces and configured to connect both sides of the latch and inner sides of the two upper walls.

According to an embodiment, the length of the at least one connection rib may be 0.6 to 1 mm.

According to another aspect of the present disclosure, a connector assembly may include: a first connector forming an accommodation space, and having a first body having a first locking protrusion on an inner side of the first body and a terminal portion formed on a first side of the first body such that a plurality of terminals is inserted therein; and a second connector having a second body configured to be inserted into the accommodation space from a second side of the first body, a latch connected to the second body and configured to form a locking structure with the first body by bending and by coming in contact with the first locking protrusion, a bridge formed adjacent to a front end of the latch on an outer side of the second body, and at least one connection rib having a first end connected to the bridge and a second end connected to the latch.

According to an embodiment, the second end of the at least one connection rib may be configured to keep connected to the latch when the second body is inserted into the accommodation space.

According to an embodiment, when a predetermined external force is applied to the front end of the latch, the at least one connection rib may be broken and the locking structure between the latch and the first body may be unlocked.

BRIEF DESCRIPTION OF DRAWINGS

The accompanying drawings, which are incorporated in and constitute a part of the specification, illustrate embodiments of the present disclosure, and together with the general description given above and the detailed description of the embodiments given below, serve to explain the principles of the present disclosure.

FIGS. 7 A, 7B, and 7C are diagrams illustrating the connection rib of the connector according to an embodiment of the present disclosure;

FIG. 11 is a table showing a test result for illustrating the characteristics of a connector assembly according to an embodiment of the present disclosure.

DETAILED DESCRIPTION

Figure 1:
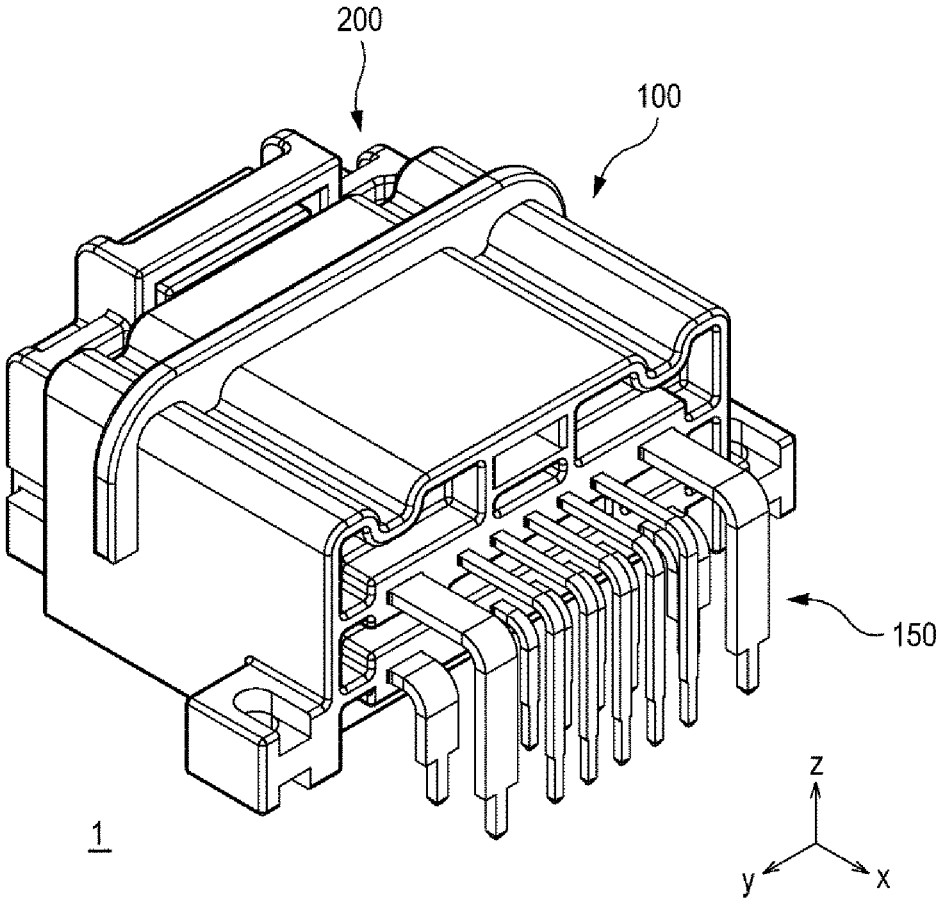
FIG. 1 is a perspective view showing the configuration of a connector assembly according to an embodiment of the present disclosure.

Embodiments described herein are provided as examples for explaining the spirit of the present disclosure. The scope of the present disclosure is not limited to the following embodiments or the detailed description of the embodiments.

In the following description, unless otherwise defined, all terms including technical and scientific terms used herein have the same meaning as commonly understood by those skilled in the art to which this invention belongs. All terms used herein are selected not to limit the scope of the present disclosure, but to make the present disclosure clearer.

The terms "comprise", "include", "have", etc. used herein should be understood as open-ended terms implying the possibility of including other embodiments, unless stated otherwise in phrases and sentences including the terms.

The singular forms "a," "an" and "the" are intended to include the plural forms as well, unless the context clearly indicates otherwise, and which will be applied in the same way to those in claims.

Terms such as 'first', 'second', etc. stated herein are used only for the purpose of distinguishing a plurality of constitutive elements from other constitutive elements, rather than to limit the order or priority of the constitutive elements.

It will be understood that when an element is referred to as being "coupled" or "connected" to another element in the present disclosure, it can be directly coupled or connected to the other element, or intervening elements may be present therebetween.

Dimensions and numerical values stated herein are not limited to the stated dimensions and numerical values. Unless specified otherwise, the dimensions and numerical values may be understood as meaning the state values and the equivalent ranges including the values. For example, a numerical value of '0.8 mm' stated herein may be understood as including 'about 0.8 m'.

Direction indication terms such as "over" and "on" used herein are based on the direction in which a bridge is positioned with respect to a latch in the accompanying drawings, and direction indication terms such as "under" and "below" mean the opposite direction. The latch shown in the accompanying drawings may be disposed in other directions and the direction indication terms may be construed to be fitted to the arrangement.

In coordinate systems shown in the drawings of this specification, an X-axial direction may be referred to as a "longitudinal direction". Further, a Y-axial direction may be referred to as a "width direction". Further, a Z-axial direction may be referred to as a "height direction".

The comparative example referred to in this specification means a connector without a connection rib. That is, it is a connector forming a free end because the rear end of the latch is not connected with a bridge.

Hereafter, embodiments of the present disclosure are described with reference to the accompanying drawings. The same or corresponding components are given the same reference numerals in the accompanying drawings. Further, repeated description of the same or corresponding components may be omitted in the following description of the embodiments. However, omission of a description of components is not intended to mean exclusion of the components from the embodiments.

FIG. 1 is a perspective view showing the configuration of a connector assembly 1 according to an embodiment of the present disclosure.

The connector assembly 1 may be configured to connect terminals constituting an electric system of a vehicle to each other. For example, the connector assembly 1 may be configured to electrically connect an Electronic Control Unit (ECU) with a transmission control circuit or an engine control circuit in a vehicle. The parts constituting the connector assembly 1 can be combined with each other through locking structures.

The connector assembly 1 may include a first connector 100 and a second connector 200. The first connector 100 may be referred to as a male connector. The second connector 200 may be referred to as a female connector. A portion of the second connector 200 may be inserted in the first connector 100. A locking structure is provided between the first connector 100 and the second connector 200, so after the second connector 200 is completely inserted in the first connector 100, the second connector 200 is not easily separated from the first connector 100. The first and second connectors 100 and 200, for example, may be made of glass fiber reinforced plastic.

A plurality of terminals 150 may be inserted in the first connector 100. The portions of the plurality of terminals 150 shown in FIG. 1 can be inserted in a control circuit attached to a vehicle. After the second connector is coupled to the first connector 100, terminals (not shown) inserted in the second connector and the plurality of terminals 150 can be in contact with each other.

Figure 2:
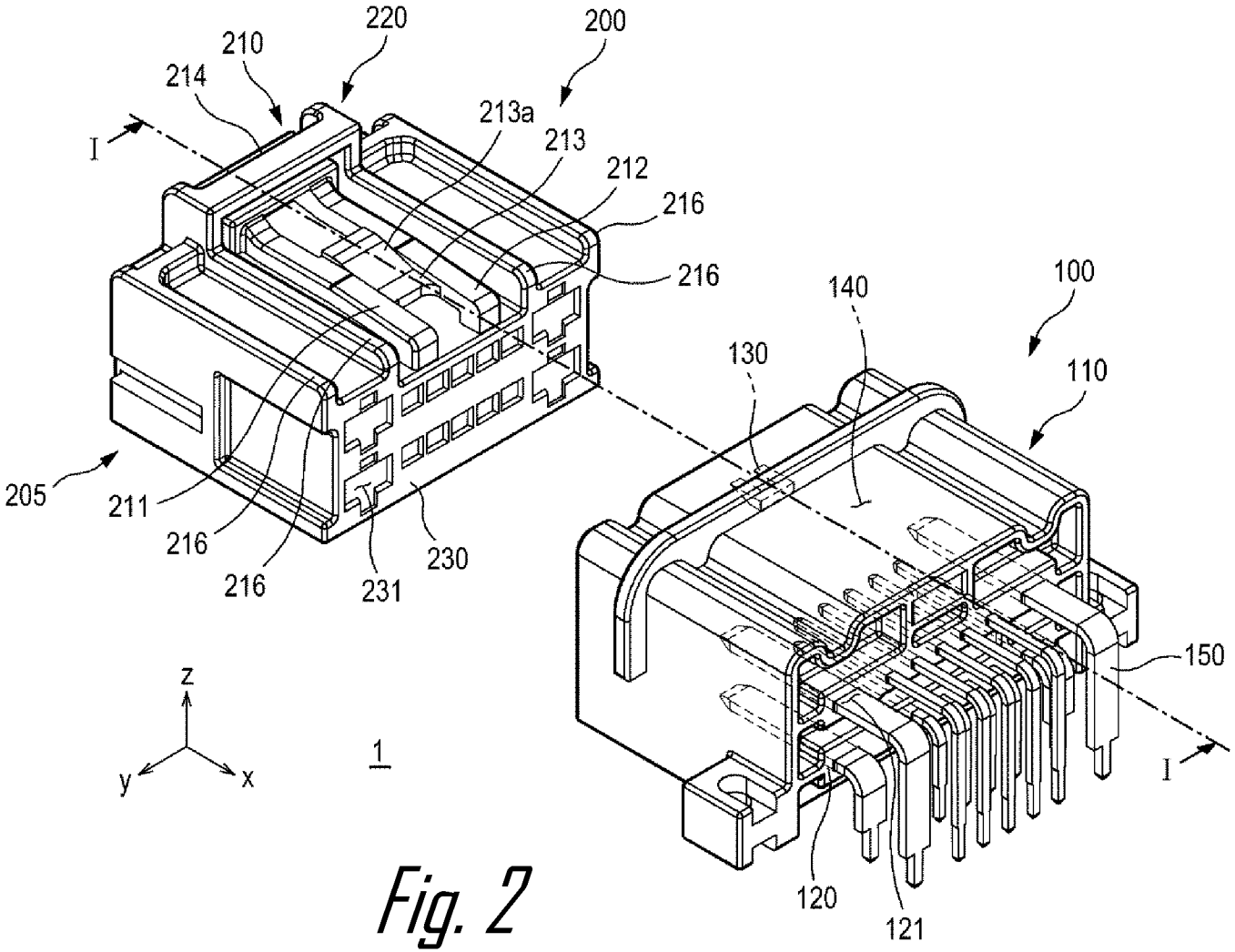
FIG. 2 is an exploded perspective view showing a disassembled configuration of the connector assembly according to an embodiment of the present disclosure.
Figure 3:
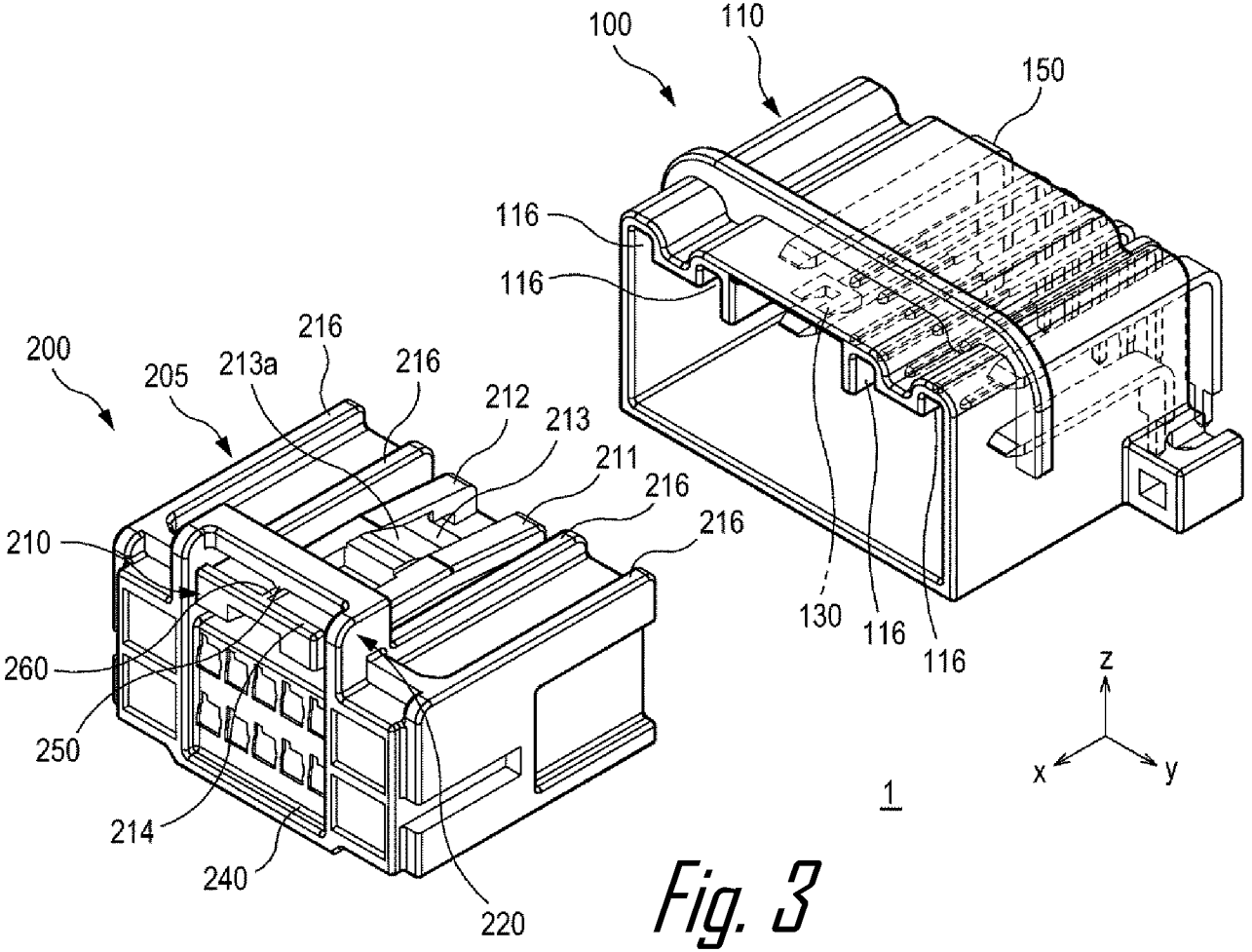
FIG. 3 is an exploded perspective view showing a configuration when seeing the connector assembly shown in FIG. 2 in a direction different from the direction of FIG. 2.

FIG. 2 is an exploded perspective view showing a disassembled configuration of the connector assembly 1 according to an embodiment of the present disclosure and FIG. 3 is an exploded perspective view showing a configuration when seeing the connector assembly 1 shown in FIG. 2 in a direction different from the direction of FIG. 2.

The first connector 100 may have a first body 110 and a terminal portion 120 formed on a side of the first body 110. The first body 110 has a shell shape and may form an accommodation space 140, and a first locking protrusion 130 may be formed on the inner side of the first body 110. A plurality of holes 121 in which the plurality of terminals 150 are inserted may be formed in the terminal portion 120.

The second connector 200 may have a second body 205 and a latch 210 connected to the top of the second body 205.

A front terminal portion 230 may be formed on the longitudinal front of the second body 205 and a rear terminal portion 240 may be formed on the longitudinal rear. The rear ends of the plurality of terminals 150 positioned in the first body 110 may be inserted in an opening 231 formed at the front terminal portion 230 of the second connector 200.

The latch 210 may have first and second latch portions 211 and 212, and a locking portion 213 formed between the first and second latch portion 211 and 212. An end of each of the first and second latch portions 211 and 212 may be connected to the front of the top of the second body 205. The first and second latch portion 211 and 212 may extend to the rear of the top of the second body 205, and a push rib 214 extending in a width direction may be formed on the other ends of the first and second latch portions 211 and 212.

A second locking protrusion 231*a* may be formed on the locking portion 213 of the latch 210. While the second connector 200 is inserted into the first connector 100, the second connector 200 comes in contact with a first locking protrusion 130 of the first body 110 and a second locking protrusion 231*a*, thereby being able to move the second locking protrusion 231*a* downward in a height direction. Accordingly, the latch 210 can be bent downward in the height direction.

A bridge 220 may be formed on the rear of the top of the second body 205. The bridge 220 may have a shape surrounding the rear end of the latch 210. The bridge 220 may have a U-shaped cross-section. The bridge 220 and the latch 210 may be connected by at least one connection rib 250.

An end of the connection rib 250 may be connected to the inner side of the bridge 220 and the other end of the connection rib 250 may be connected to the top of the latch 210. Further, a latch rib 260 may be formed between the other end of the connection rib 250 and the top of the latch 210. The latch rib 260 may extend in the longitudinal direction of the latch 210 from the push rib 214 to the other end of the connection rib 250. The push rib 214 may be positioned behind the bridge 220 in the longitudinal direction.

The connection rib 250, for example, may have a length between 0.6 and 1 mm. For example, the connection rib 250 may have a size of 0.8 mm. In a connector assembly according to a comparative example, the gap between a bridge and a latch is generally larger than 1 mm, so the height of the bridge in the height direction may be greater than the height of the second connector 200 according to an embodiment. However, the gap between the bridge 220 and the latch 210 decreases in the second connector 200, so the length in the height direction of the second connector 200 can be reduced.

A plurality of guide ribs 216 extending in the longitudinal direction of the second body 205 may be formed on the outer side of the second body 205. Further, a plurality of guide grooves 116 in which the plurality of guide ribs 216 are inserted and that extends in the longitudinal direction of the first body 110 may be formed on the inner side of the first body 110. While the second body 205 is inserted into the first body 110, the plurality of guide ribs 216 are inserted into the plurality of guide grooves 116, so the second body 205 can be accurately inserted into the first body 110 in the longitudinal direction of the first body 110 without being biased.

Figure 4:
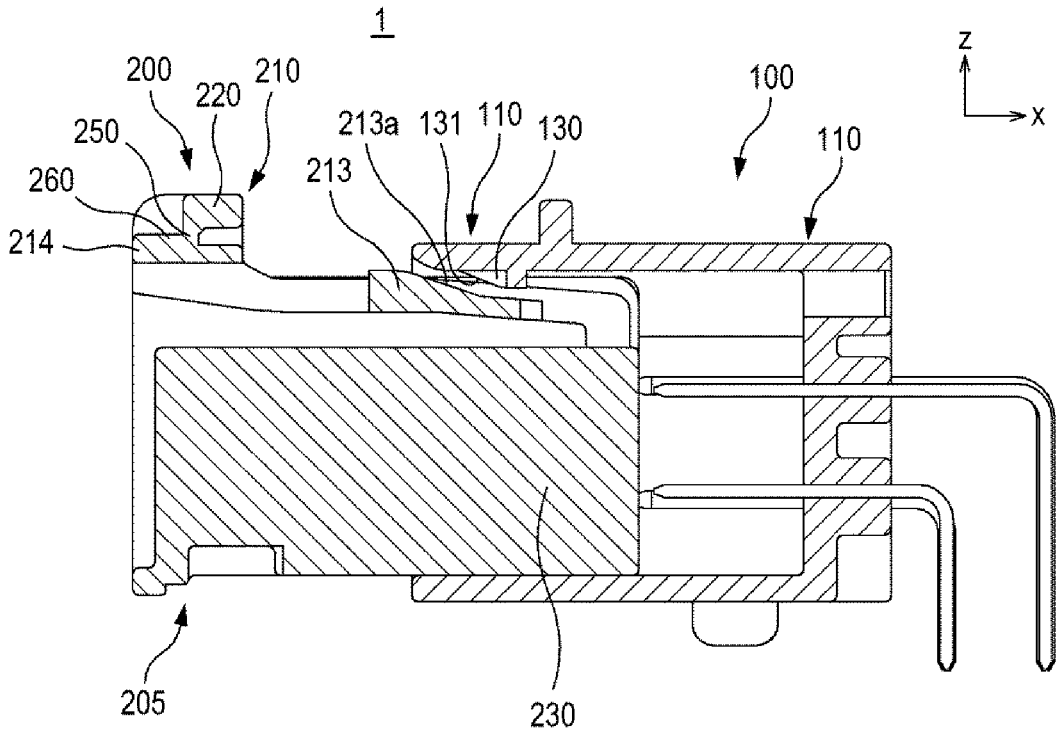
FIG. 4 is a cross-sectional view illustrating a process in which the connector assembly shown in FIG. 2 is locked.
Figure 5:
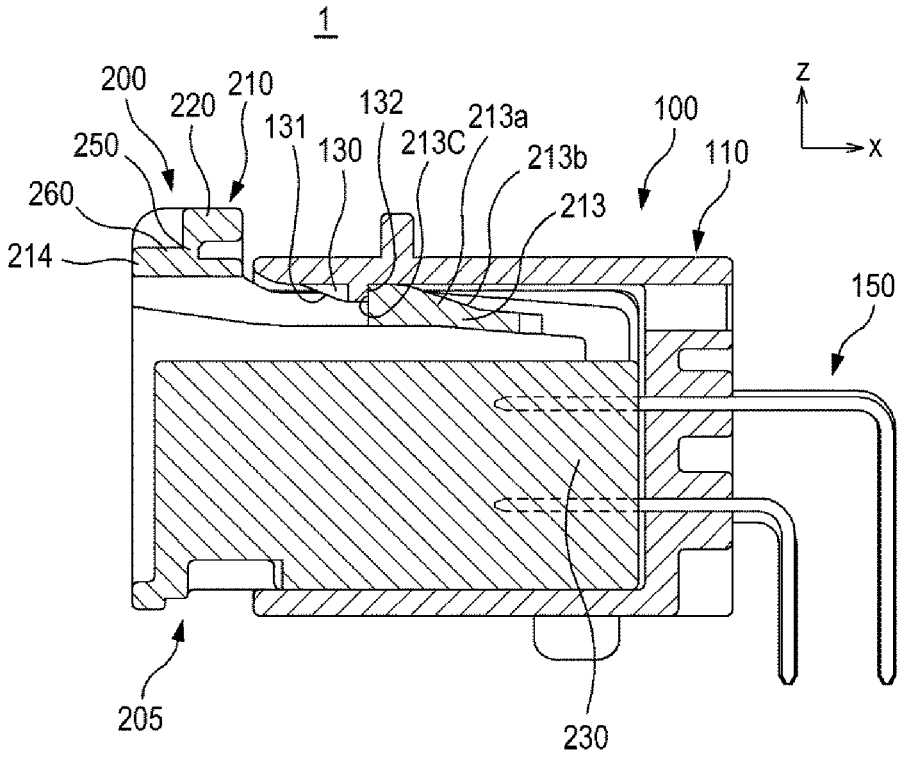
FIG. 5 is a cross-sectional view illustrating the state in which the connector assembly shown in FIG. 2 is locked.

FIG. 4 is a cross-sectional view illustrating a process in which the connector assembly 1 shown in FIG. 2 is locked and FIG. 5 is a cross-sectional view illustrating the state in which the connector assembly 1 shown in FIG. 2 is locked. FIGS. 4 and 5 show a cross-section of the connector assembly 1 shown in FIG. 2 taken along line I-I.

The connector assembly 1 may include a locking structure for preventing separation of the second connector 200 from the first connector 100. The locking structure may be formed by the second locking protrusion 213*a* of the latch 210 and the first locking protrusion 130 of the first body 110. When the second connector 200 is moved to the first connector 100, most part of the second body 205 except for the portion where the bridge 220 is formed in the longitudinal direction can be inserted into the first body 110.

The first locking protrusion 130 may have a first inclined surface 131 and the second locking protrusion 213*a* may have a second inclined surface 213*b*. The first inclined surface 131 and the second inclined surface 213*b* may be inclined in the same direction to face each other. When the second connector 200 is moved toward the first connector 100, the second inclined surface 213*b* comes in contact with the first inclined surface 131. Since an empty space is defined under the latch 210, the locking portion 213 can be bent downward in the height direction. Further, the first and second latch portions 211 and 212 connected to a side of the locking portion 213 may also be bent together.

In the manner according to a comparative example, a connection rib is not formed between a bridge and a latch, so the latch is rotated in the locking process, and accordingly, a rear end of the latch becomes far away from the bridge. However, in an embodiment, the rear end of the latch 210 is not spaced far away from the bridge 220 by the connection rib 250. Accordingly, in the locking process, the center portion of the latch 210 including the locking portion 213 can be bent downward in the height direction with both ends of the latch 210 fixed. Further, as compared with a comparative example in which the front end of a latch exists as a free end, the latch 210 can provide a stronger resistance force in the locking process.

Referring to FIG. 5, after the second connector 200 is completely inserted in the first connector 100, the connector assembly 1 can be in a locked state. In this state, the rear end surface 213*c* of the second locking protrusion 213*a* faces the rear end surface 132 of the first locking protrusion 130. Accordingly, even if a user intends to separate the second connector 200 from the first connector 100 by applying a force, the rear end surface 213*c* of the second locking protrusion 213*a* is locked to the rear end surface 132 of the first locking protrusion 130, so the second connector 200 is not pulled out of the first connector 100.

In order to remove the locked state, it is possible to move the latch 210 downward in the height direction by applying external force to the latch 210. In an embodiment, since the bridge 220 and the latch 210 are connected by the connection rib 250, the latch 210 is not moved sufficiently without the connection rib 250 broken. Accordingly, when the connection rib 250 is broken by an external force having strength that can break the connection rib 250, the upper end of the second locking protrusion 213*a* is positioned lower than the lower end of the first locking protrusion 130 in the height direction, so the second connector 200 can be separated from the first connector 100.

Figure 6A:
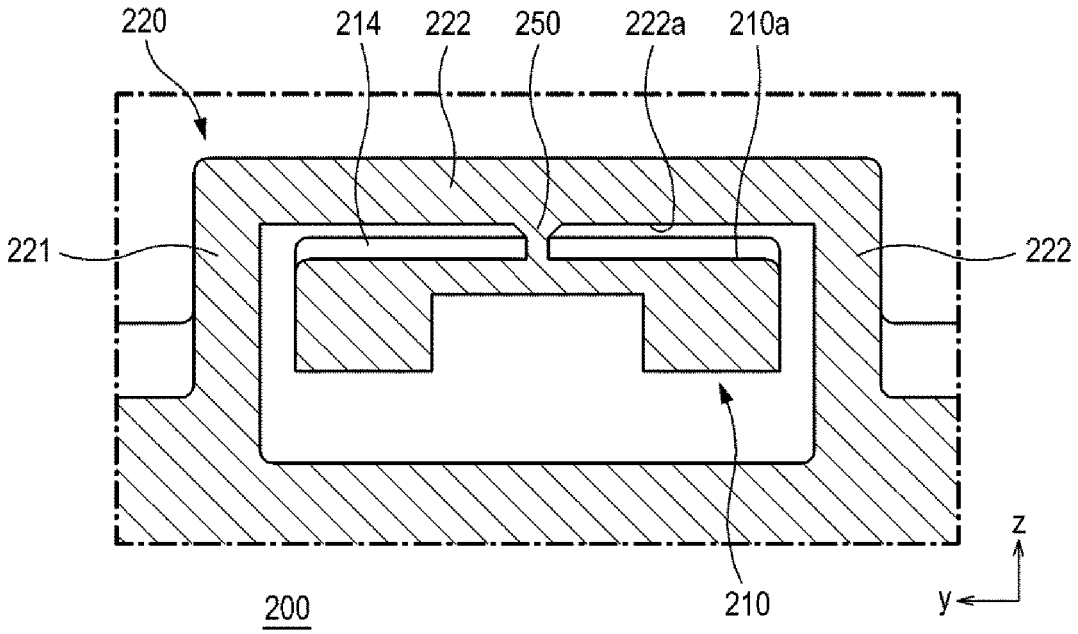
FIGS. 6A and 6B are diagrams illustrating a connection rib of a connector according to an embodiment of the present disclosure.
Figure 6B:
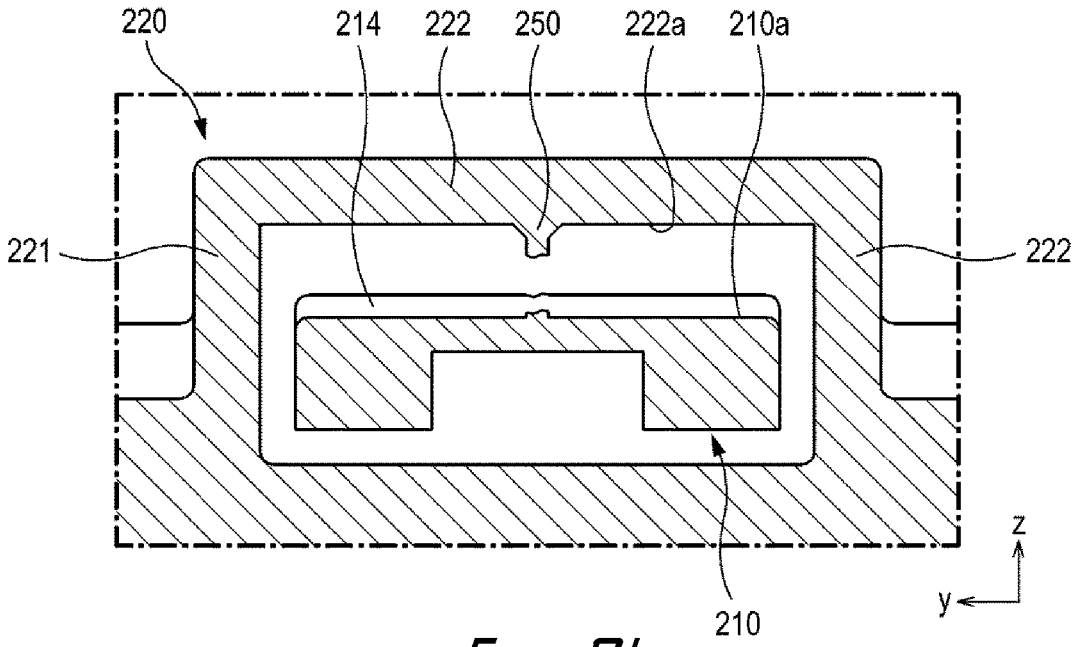

FIGS. 6A and 6B are diagrams illustrating the connection rib 250 of the second connector 200 according to an embodiment of the present disclosure. The connector 200 may be referred to as the second connector 200 described in the above embodiment. FIG. 6 shows a cross-section cutting the second connector 200 across the connection rib 250 in the height direction.

The bridge 220 may have two side walls 221 formed at both sides of the latch 210 and an upper wall 222 connecting the upper ends of the two side walls 221. Further, an end of the connection rib 250 may be connected to the inner side 222*a* of the upper wall 222 and the other end of the connection rib 250 may be connected to the top 210*a* of the latch 210.

The connection rib 250 may be configured to connect the center portion of the upper wall 222 and the center portion of the latch 210. That is, an end of the connection rib 250 may be positioned at the center of the inner side 222*a* of the upper wall 222 and the other end of the connection rib 250 may be positioned at the center of the top 210*a* of the latch 210. Accordingly, the connection rib 250 may be formed in the height direction of the second connector 200. In another embodiment, the latch rib 260 may not be provided on the second connector 200 and the other end of the connection rib 250 may be directly connected to the top 210*a* of the latch 210.

In order to unlock the first connector 100 and the second connector 200 from each other, it is required to break the connection rib 250 to apply an external force larger than a predetermined magnitude to the push rib 214. Referring to FIG. 6A, the connection rib 250 is not broken when an external force larger than a predetermined magnitude is not applied to the front end of the latch 210, that is, the push rib 214. Referring to FIG. 6B, the state in which the connection rib 250 has been broken by applying an external force larger than a predetermined magnitude to the push rib 214 is shown. For example, when the cross-sectional area of an end of the connection rib 250 is larger than the cross-sectional area of the other end of the connection rib 250, the joint between the other end of the connection rib 250 and the top 210*a* of the latch 210 can be broken.

FIGS. 7A and 7B are diagrams illustrating a connection rib 350 of a connector 300 according to an embodiment of the present disclosure. Repeated description for the configuration described in the above embodiment is omitted. FIGS. 7A and 7B show a cross-section cutting the connector 300 across the connection rib 350 in the height direction.

The bridge 320 may have two side walls 321 formed at both sides of the latch 310 and an upper wall 322 connecting the upper ends of the two side walls 321. Further, two connection ribs 350 may be provided to connect both sides 310*a* of the latch 310 and the upper wall 322 of the bridge 320 to each other.

The upper ends of the two connection ribs 350 may be connected to both edges of the inner side 322*a* of the upper wall 322. Further, the lower ends of the two connection ribs 350 may be connected to both sides 310*b* of the latch 310, respectively. In detail, the inner sides of the lower ends of the two connection ribs 350 may be connected to both sides 310*b* of the latch 310, respectively. In this embodiment, a latch rib may not be provided unlike the second connector 200 shown in FIG. 2.

Referring to FIG. 7A, the two connection ribs 350 are not broken when an external force larger than a predetermined magnitude is not applied to the front end of the latch 310, that is, the push rib 314. Referring to FIG. 7B, the state in which the two connection ribs 350 have been broken by applying an external force larger than a predetermined magnitude to the push rib 314 is shown. For example, when the cross-sectional areas of the upper ends of the two connection ribs 350 are larger than the cross-sectional areas of the lower ends of the connection ribs 350, the joints between the lower ends of the connection ribs 350 and both sides 310*b* of the latch 310 can be broken.

Referring to FIG. 7B, after the latch 310 is separated from the bridge 320, broken portions 310*d* may be formed at the corners of the both upper ends of the latch 310. The angle that the broken portions 310*d* make with respect to the width direction may be about 45°. Since the broken portions 310*d* are formed, as described above, the connection ribs 350 and the latch 310 can be separated smoothly from each other without burrs thereon.

Figure 8A:
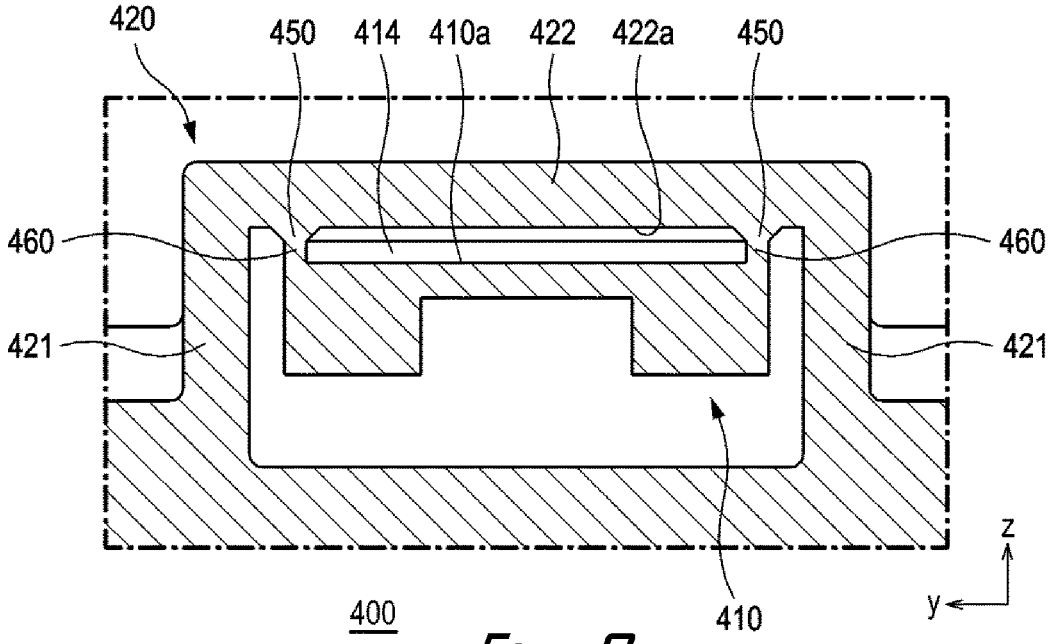
FIGS. 8A and 8B are diagrams illustrating the connection rib of the connector according to an embodiment of the present disclosure.
Figure 8B:
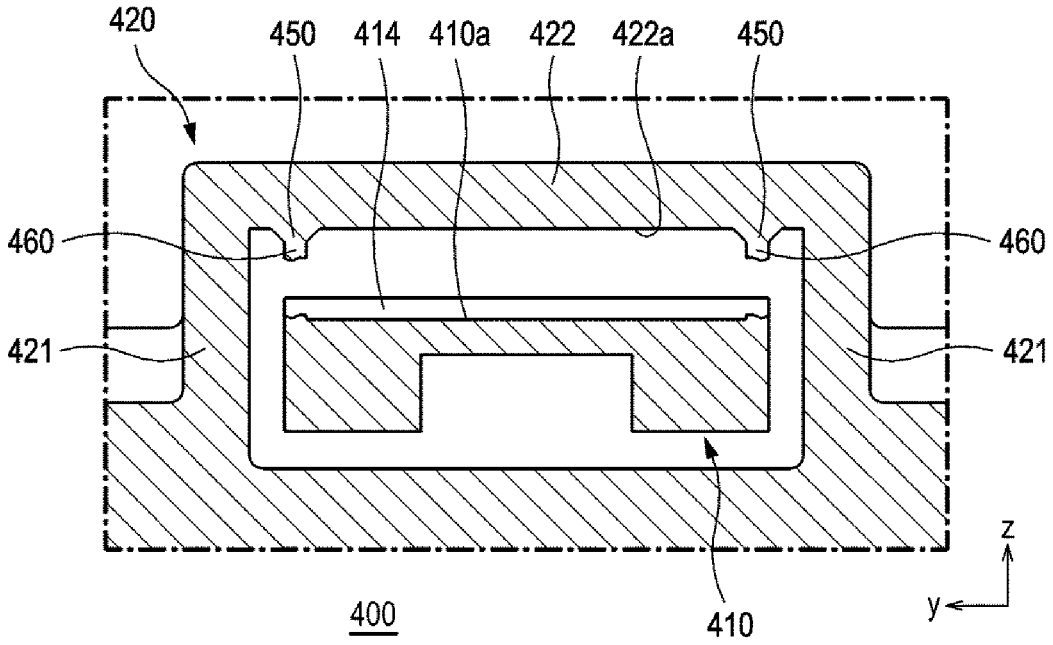

FIGS. 8A and 8B are diagrams illustrating a connection rib 450 of a connector 400 according to an embodiment of the present disclosure. Repeated description for the configuration described in the above embodiment is omitted. FIG. 8 shows a cross-section cutting the connector 400 across the connection rib 450 in the height direction.

A bridge 420 may have two side walls 421 formed at both sides of a latch 410 and an upper wall 422 connecting the upper ends of the two side walls 421. Further, two connection ribs 450 may be provided to connect both edges of the top 410*a* of the latch 410 and the inner side 422*a* of the upper wall 422 to each other. That is, the two connection ribs 450 may extend in the height direction of the connector 400.

The upper ends of the two connection ribs 450 may be connected to both edges of the inner side 422*a* of the upper wall 422. Further, the lower ends of the two connection ribs 450 may be connected to both edges of the top 410*a* of the latch 410, respectively. Further, in the embodiment, two latch ribs 460 may be formed at both edges of the top 410*a* of the latch 410 in the longitudinal direction of the latch 410. That is, two latch ribs 460 may be provided between the lower ends of the two connection ribs 450 and the top 410*a* of the latch 410. In another embodiment, the latch rib 460 may not be provided on the connector 400 and the other end of the connection rib 450 may be directly connected to the top 410*a* of the latch 410.

Referring to FIG. 8A, the two connection ribs 450 are not broken when an external force larger than a predetermined magnitude is not applied to the front end of the latch 410, that is, the push rib 414. Referring to FIG. 8B, the state in which the two connection ribs 450 have been broken by applying an external force larger than a predetermined magnitude to the push rib 414 is shown. For example, when the cross-sectional areas of the upper ends of the two connection ribs 450 are larger than the cross-sectional areas of the lower ends of the connection ribs 450, the joints between the lower ends of the two connection ribs 450 and the top 410*a* of the latch 410 can be broken.

Figure 9A:
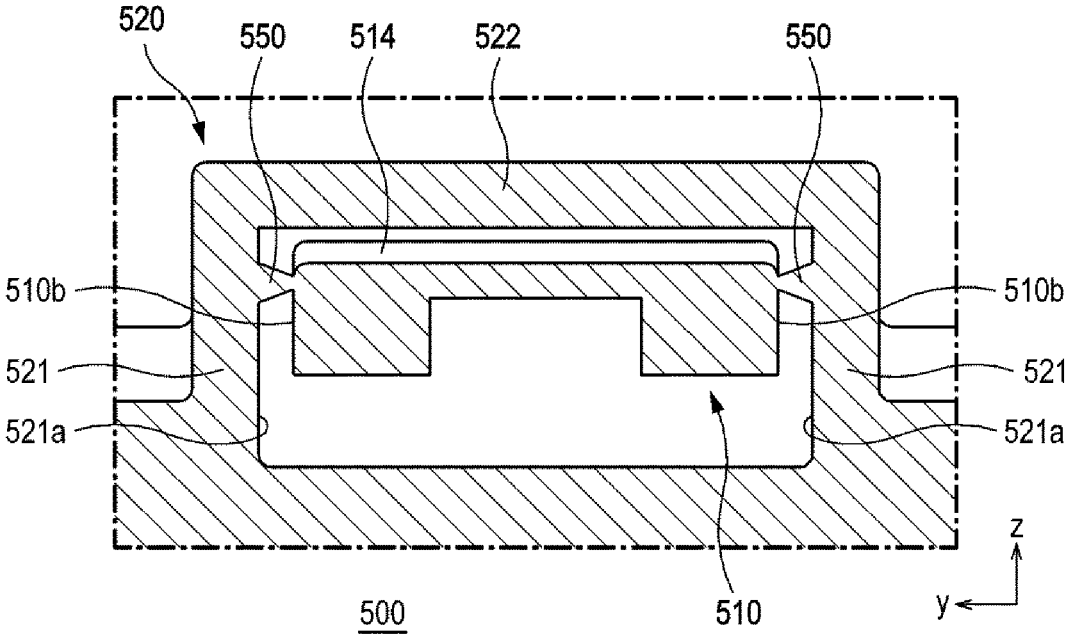
FIGS. 9A and 9B are diagrams illustrating the connection rib of the connector according to an embodiment of the present disclosure.
Figure 9B:
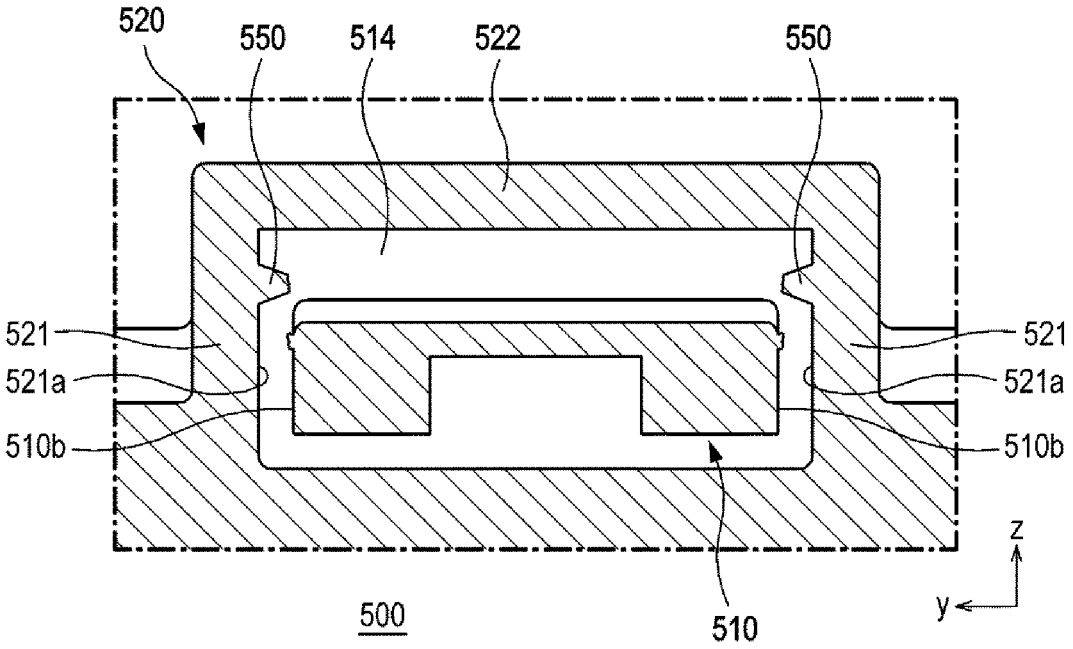

FIGS. 9A and 9B are diagrams illustrating a connection rib 550 of a connector 500 according to an embodiment of the present disclosure. Repeated description for the configuration described in the above embodiment is omitted.

A bridge 520 may have two side walls 521 formed at both sides of a latch 510 and an upper wall 522 connecting the upper ends of the two side walls 521. Further, two connection ribs 550 may be provided to connect both sides 510*b* of the latch 510 and the inner sides 521*a* of the two side walls 521 to each other. That is, the two connection ribs 550 may extend in the width direction of the connector 500.

An end of each of the two connection ribs 550 may be connected to the upper portions of the inner sides 521*a* of the two side walls 521. Further, the other ends of the two connection ribs 550 may be connected to the upper portions of the sides 510*b* of the latch 510, respectively. In this embodiment, a latch rib may not be provided unlike the second connector 200 shown in FIG. 2.

Referring to FIG. 9A, the two connection ribs 550 are not broken when an external force larger than a predetermined magnitude is not applied to the front end of the latch 510, that is, the push rib 514. Referring to FIG. 9B, the state in which the two connection ribs 550 have been broken by applying an external force larger than a predetermined magnitude to the push rib 514 is shown. For example, when the cross-sectional areas of ends of the two connection ribs 550 is larger than the cross-sectional areas of the other ends of the connection ribs 550, the joints between the other ends of the two connection ribs 550 and both sides 510*b* of the latch 510 can be broken.

Figure 10A:
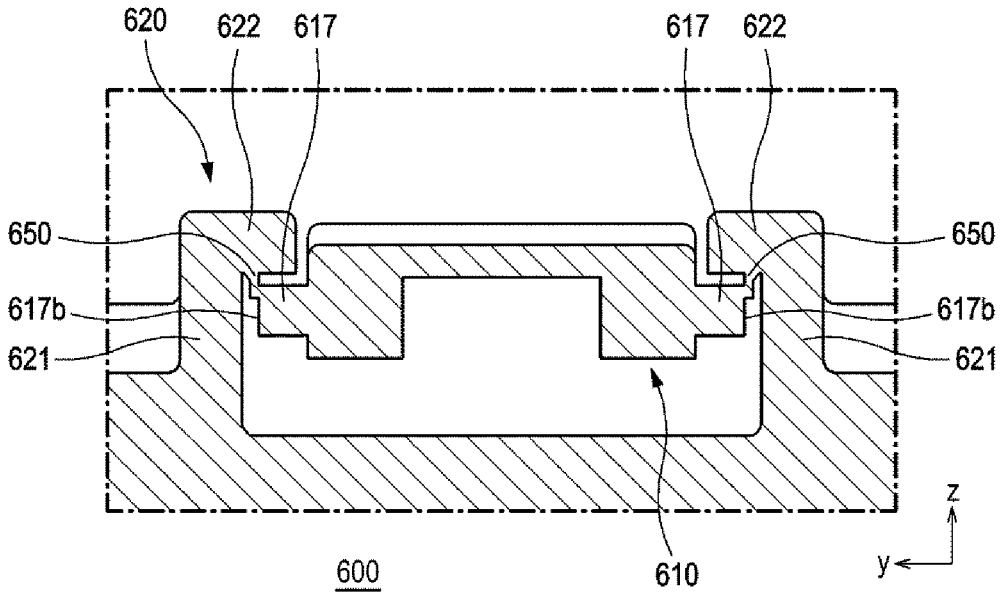
FIGS. 10A and 10B are diagrams illustrating the connection rib of the connector according to an embodiment of the present disclosure.
Figure 10B:
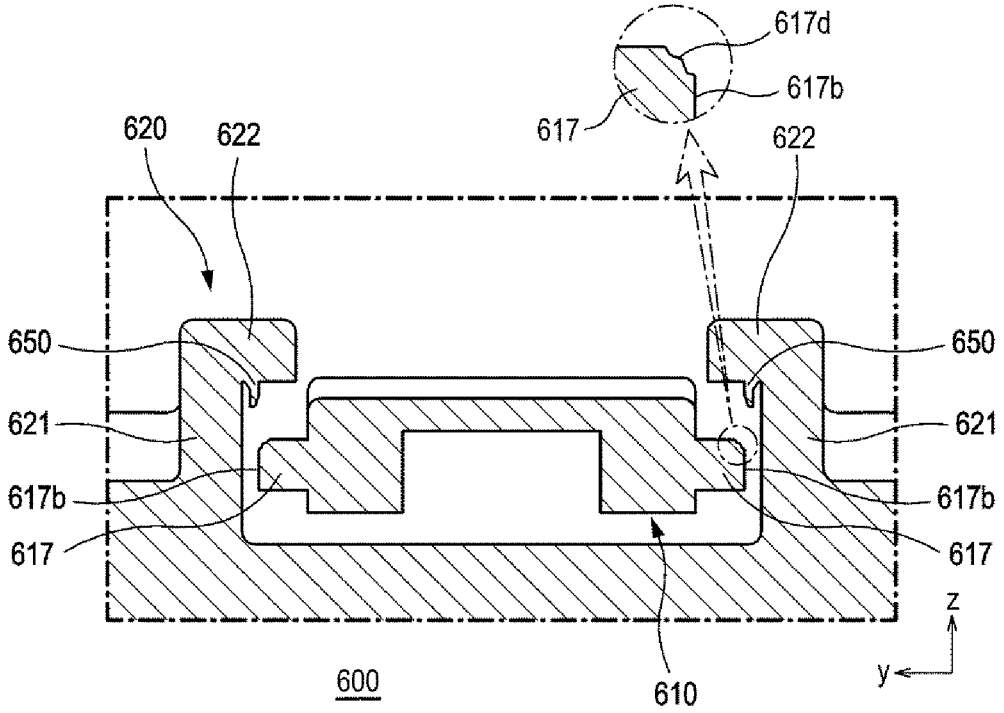

FIGS. 10A and 10B are diagrams illustrating a connection rib 650 of a connector 600 according to an embodiment of the present disclosure. Repeated description for the configuration described in the above embodiment is omitted.

A bridge 620 may have two side walls 21 formed at both sides of a latch 610 and two upper walls 622 extending toward the latch 610 from the two side walls, respectively, with the latch 610 therebetween. That is, the upper portion of the latch 610 may be disposed between inner front ends of the two upper walls 622. Further, two connection ribs 650 may be provided to connect both sides 610*b* of the latch 610 and the two upper walls 622 of the bridge 620 to each other.

The latch 610 may have two protrusion 617 protruding to both sides in the longitudinal direction. Further, the two connection ribs 650 may be configured to connect both sides 617*b* of the protrusions 617 and the two upper walls 622 of the bridge 620 to each other. The upper ends of the two connection ribs 650 may be connected to the inner sides 622*a* of the two upper walls 622. Further, the lower ends of the two connection ribs 650 may be connected to both sides 617*b* of the protrusions 617, respectively. In this embodiment, a latch rib may not be provided unlike the second connector 200 shown in FIG. 2.

Referring to FIG. 10A, the two connection ribs 650 are not broken when an external force larger than a predetermined magnitude is not applied to the front end of the latch 610, that is, the push rib 614. Referring to FIG. 10B, the state in which the two connection ribs 650 have been broken by applying an external force larger than a predetermined magnitude to the push rib 614 is shown. For example, when the cross-sectional areas of the upper ends of the two connection ribs 650 are larger than the cross-sectional areas of the lower ends of the connection ribs 650, the joints between the lower ends of the connection ribs 650 and both sides 617*b* of the protrusions 617 can be broken.

Referring to FIG. 10B, after the latch 610 is separated from the bridge 620, broken portions 617*d* may be formed at the corners of the both upper ends of the protrusions 617. The angle that the broken portions 617*d* make with respect to the width direction may be about 45°. Since the broken portions 617*d* are formed, as described above, the connection ribs 650 and the protrusions 617 can be separated smoothly from each other without the occurrence of burr.

FIG. 11 is a table showing a test result for illustrating the characteristics of the connector assembly 1 according to an embodiment of the present disclosure. The following test result is described with reference to the configuration shown in FIGS. 1 to 3.

Referring to the first line, the examination item is a connector insertion force. The condition required for the connector assembly 1 is that the connector insertion force should be 74.5 N or less. That is, when the insertion force that is applied until the second connector 200 is locked to the first connector 100 is 74.5 N, the required condition can be satisfied. According to the test result, the connector assembly 1 according to an embodiment of the present disclosure may have a slight large connector insertion force in comparison to the comparative example, but it was found out that the required condition was satisfied.

Referring to the second line, the examination item is an unlocking force. The condition required for the connector assembly 1 is that unlocking should be made within the range of 0.5 to 58.8 newtons (N). That is, when the latch 210 is pressed by an external force of 0.5 to 58.8 N, the latch 210 is sufficiently pressed and the second connector 200 can be separated from the first connector 100, the required condition can be satisfied. The connector assembly 1 according to an embodiment of the present disclosure may have a slightly larger unlocking force in comparison to the comparative example, but it was found out that the required condition was satisfied. According to an embodiment of the present disclosure, there is a need for an external force having a predetermined magnitude for separating the latch 210 from the bridge 220 by breaking the connection rib 250. Further, according to the test result, it was found that the range in which a common worker can easily separate it by hand was satisfied.

Referring to the third line, the examination item is a connector insertion force. The condition required for the connector assembly 1 is that a connector fastening sound should be 65 dB or more when measured at a distance 700±10 mm from the connector assembly. It was found that the connector assembly 1 according to an embodiment of the present disclosure has a slightly larger connector fastening sound in comparison to the connector assembly of the comparative example. According to an embodiment of the present disclosure, as compared with the connector assembly according to the comparative example, it is possible to generate a large connector fastening sound, and confidence in locking for a worker (e.g., secured locking of the connector) can be improved. Further, the worker can be sure that the connector is locked.

According to an embodiment of the present disclosure, the connection rib maintains the gap between the latch and the bridge, so sagging of the latch with respect to the bridge is prevented. Further, the gap between the bridge and the latch is small, so the length in the height direction of the connector can be designed to be small. Further, it is possible to improve a connector fastening sound even without increasing the male connector insertion force to the female connector.

Although the present disclosure has been described in relation to some embodiments, it should be noted that there may be various modifications and changes without departing from the spirit and scope of the present disclosure, which can be understood by those skilled in the art. In addition, such modifications and changes should be construed to belong to the scope of the claims appended herein.

We claim:

1. A connector comprising:

a body in which at least one terminal is inserted;

a bridge formed on a first side of the body;

a latch connected to a second side of the body and extending toward the bridge; and at least one connection rib having a first end connected to an inner side of the bridge and a second end connected to an outer side of the latch wherein the connection of the first end of the connection rib to the bridge and second end of the connection rib to the latch prevents downward movement of the latch relative to the bridge until the connection rib is broken.

2. The connector of claim 1, wherein the bridge has two side walls formed at both sides of the latch and an upper wall connecting upper ends of the two side walls, and the first end of the at least one connection rib is connected to an inner side of the upper wall and the second end of the at least one connection rib is connected to a top of the latch.

3. The connector of claim 2, wherein the at least one connection rib is configured to connect a center portion of the upper wall and a center portion of the latch.

4. The connector of claim 2, wherein the latch has a latch rib extending in a longitudinal direction of the latch and connected to the second end of the at least one connection rib.

5. The connector of claim 1, wherein the bridge has two side walls formed at both sides of the latch and an upper wall connecting upper ends of the two side walls, and the at least one connection rib is provided as two pieces and configured to connect both sides of the latch and the upper wall of the bridge.

6. The connector of claim 1, wherein the bridge has two side walls formed at both sides of the latch and an upper wall connecting upper ends of the two side walls, and the at least one connection rib is provided as two pieces and configured to connect both edges of a top of the latch and an inner side of the upper wall.

7. The connector of claim 1, wherein the bridge has two side walls formed at both sides of the latch, and the at least one connection rib is provided as two pieces and configured to connect both sides of the latch and inner sides of the two side walls.

8. The connector of claim 1, wherein the bridge has two side walls formed at both sides of the latch and two upper walls extending respectively from the two side walls toward the latch with the latch therebetween, and the at least one connection rib is provided as two pieces and configured to connect both sides of the latch and inner sides of the two upper walls.

9. The connector of claim 1, wherein a length of the at least one connection rib is 0.6 to 1 mm.

10. The connector of claim 1, wherein the first end of the at least one connection rib is integrally connected to the inner side of the bridge and the second of the at least one connection rib is integrally connected to the outer side of the latch.

11. A connector assembly comprising:

a first connector forming an accommodation space, and having a first body having a first locking protrusion on an inner side of the first body and a terminal portion formed on a first side of the first body such that a plurality of terminals is inserted therein; and a second connector having a second body configured to be inserted into the accommodation space from a second side of the first body, a latch connected to the second body and configured to form a locking structure with the first body by bending and by coming in contact with the first locking protrusion, a bridge formed adjacent to a front end of the latch on an outer side of the second body, and at least one connection rib having a first end connected to the bridge and a second end connected to the latch wherein when an external force is applied to the front end of the latch, the at least one connection rib is broken and the locking structure between the latch and the first body is unlocked.

12. The connector assembly of claim 11, wherein the second end of the at least one connection rib is configured to keep connected to the latch when the second body is inserted into the accommodation space.

13. The connector assembly of claim 11, wherein the first end of the at least one connection rib is integrally connected to the inner side of the bridge and the second of the at least one connection rib is integrally connected to the outer side of the latch.

* * * * *